United States Patent [19]

Ferguson et al.

[11] Patent Number: 4,575,996

[45] Date of Patent: Mar. 18, 1986

[54] HORSE WIND AND MUD DEFLECTOR

[76] Inventors: Glenn R. Ferguson, Rte. 1 Box 305, Cusick, Wash. 99119; Kenneth R. Ferguson, 1184 Foothill Rd., Box 283, Moscow, Id. 83843

[21] Appl. No.: 690,779

[22] Filed: Jan. 11, 1985

[51] Int. Cl.[4] ..... B68C 5/00

[52] U.S. Cl. ..... 54/80; 54/20

[58] Field of Search ..... 54/2, 20, 59, 67, 80; 119/143

[56] References Cited

U.S. PATENT DOCUMENTS

| | | | |
|---|---|---|---|
| 343,210 | 6/1886 | Tourgee | 54/20 |
| 368,747 | 8/1887 | Barlow | 54/20 X |
| 423,566 | 3/1890 | Mendel | 54/20 |
| 564,089 | 7/1896 | Lehman | 54/20 |

*Primary Examiner*—Robert P. Swiatek

*Attorney, Agent, or Firm*—Wells, St. John & Roberts

[57] ABSTRACT

A wind and mud deflector mounts by a strap arrangement to the chest and shoulder area of a race horse to render the chest area more aerodynamic and to deflect mud or debris from the chest and shoulder areas. The deflector is formed of a relatively thin flexible sheet material including a wedge or pointed forward section leading to side panels positionable on opposite sides of the horse. The panels include a neck recess and shoulder recesses for loosely receiving the neck and forward shoulder areas of the horse. The strap assembly is used to secure the deflector to the horse and hold the deflector such that the neck and shoulder recesses remain properly positioned. A pad is provided about peripheral edges of the deflector to avoid chafing.

19 Claims, 5 Drawing Figures

FIG 1
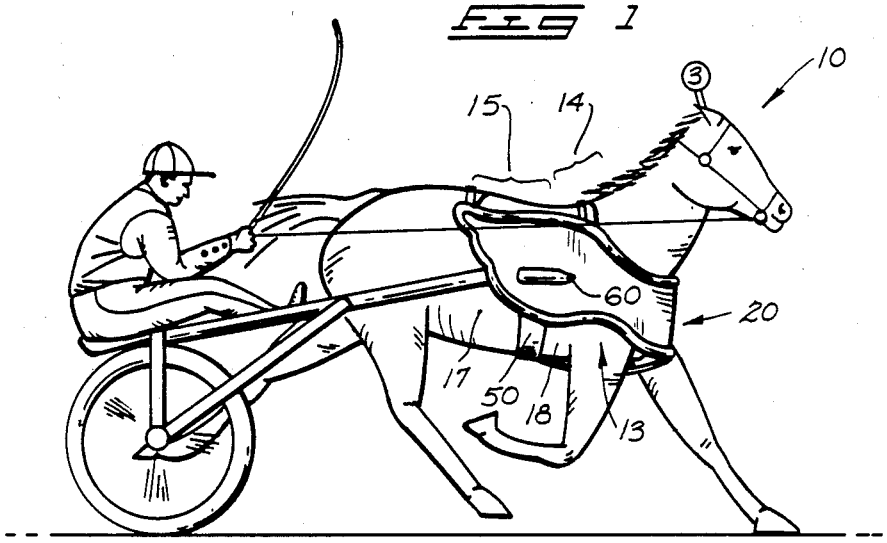
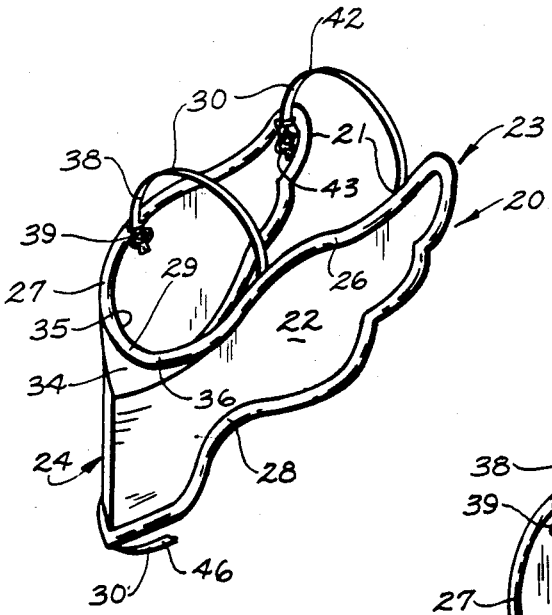
FIG 2
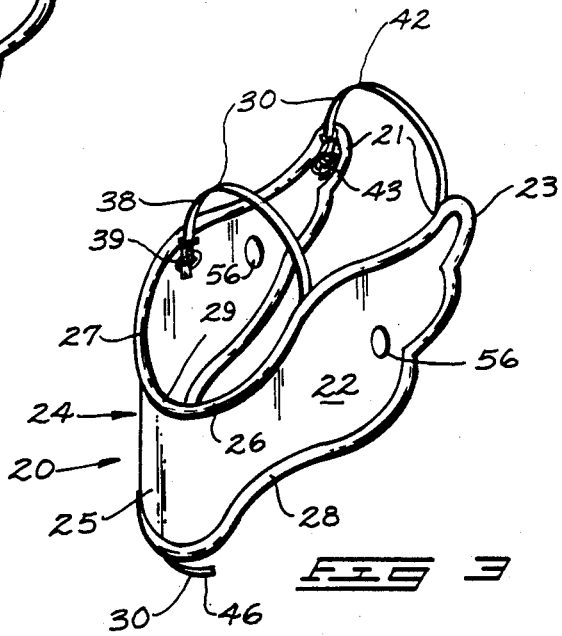
FIG 3

HORSE WIND AND MUD DEFLECTOR

FIELD OF THE INVENTION

The present invention relates to apparatus for deflection of air and mud from the breast area of a horse.

RELATED DOCUMENTS

This information has been recorded in the United States Patent and Trademark Office by disclosure document, Ser. No. 128,940, filed July 6, 1984.

BACKGROUND

A running, trotting, or pacing horse in saddle or sulky racing meets substantial resistance to movement through the air due in part to the large surface area of the horse's chest facing the direction of movement. It has been calculated that the breast area of a horse trotting or pacing at 32 miles per hour produces a "drag" of approximately 24 pounds. This is due primarily to the shape of the frontal or chest area of the horse which may occupy in the vicinity of 252 square inches or 1,626 square cm. The problem of reducing drag in this area has gone substantially unrecognized.

Improving horse "aerodynamics" has not been considered as a possible area for improvement to increase speed. Attention has been focused instead to develop optimum speed by minimizing jockey weight and the jockey's stance while riding. In the case of harness racing, much emphasis is placed on the cart weight and design to optimize speed.

Another problem confronting both saddle and harness racers is mud. Mud is kicked up by leading horses in a race and strikes the broad, breast area of the horses immediately following. This mud can build up to an uncomfortable extent over the horse's chest area. Many horses will fall back to a safe distance behind a leading horse to avoid the painful impact of mud clods and discomfort of clinging mud.

It may therefore be understood that there exists a need to "streamline" or reduce the drag of a running or trotting horse and, further, to protect the frontal chest area of the horse against buildup and impact of mud or other debris in wet racing conditions.

BRIEF DESCRIPTION OF THE DRAWINGS

Preferred embodiments of the present invention are illustrated in the accompanying drawings in which:

FIG. 1 is a diagrammatic view of a horse and sulky with the present deflector in use;

FIG. 2 is a pictorial view of a form of the present deflector for use with saddle racing horses;

FIG. 3 is a pictorial view of the present deflector for use in sulky or cart racing;

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 4:
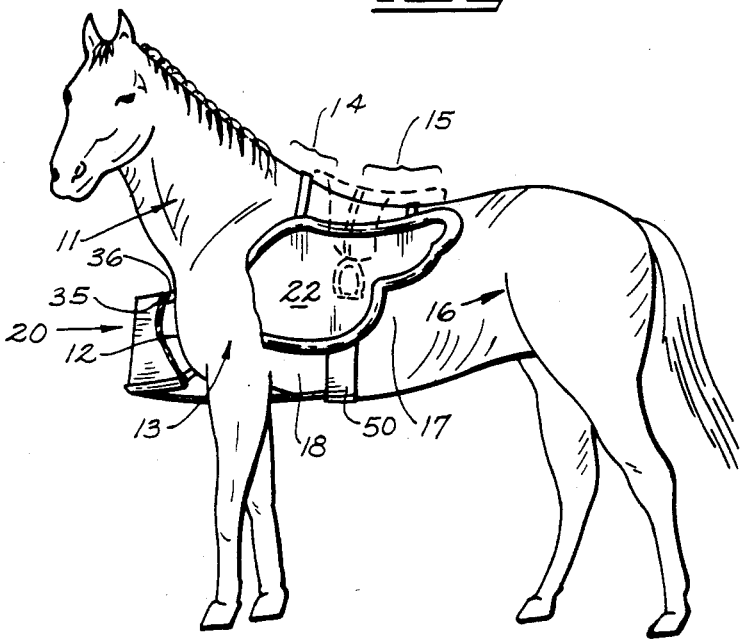
FIG. 4 is a diagrammatic view of a saddle horse with the deflector shown in FIG. 2 mounted thereon.

A horse is generally shown by the reference numeral 10 in FIGS. 1 and 4. For purposes of this description, several anatomical features of the horse 10 will be briefly and generally discussed as they relate to particular features of the present invention. To this end, the horse is described including a neck area designated at 11 and a frontal or breast area 12. Front shoulders are indicated at 13. The upper neck where it joins the horse's back is termed the "withers" and is indicated by the bracketed area 14 in FIGS. 1 and 4. The back is shown at 15 and extends from the withers 14 to the hip area 16. Ribs 17 and brisket 18 are also identified in the drawings.

Both forms of the present deflector are indicated at 20. Each is formed of a flexible, water-impervious material such as plastic in sheet form to substantially cover the chest area of the horse. The deflector 20 offers protection by shielding the chest area of the horse against mud or other material "kicked up" by the leading horses in a race, and reduces the air resistance or drag normally produced by the relatively flat chest area of the horse.

Figure 5:
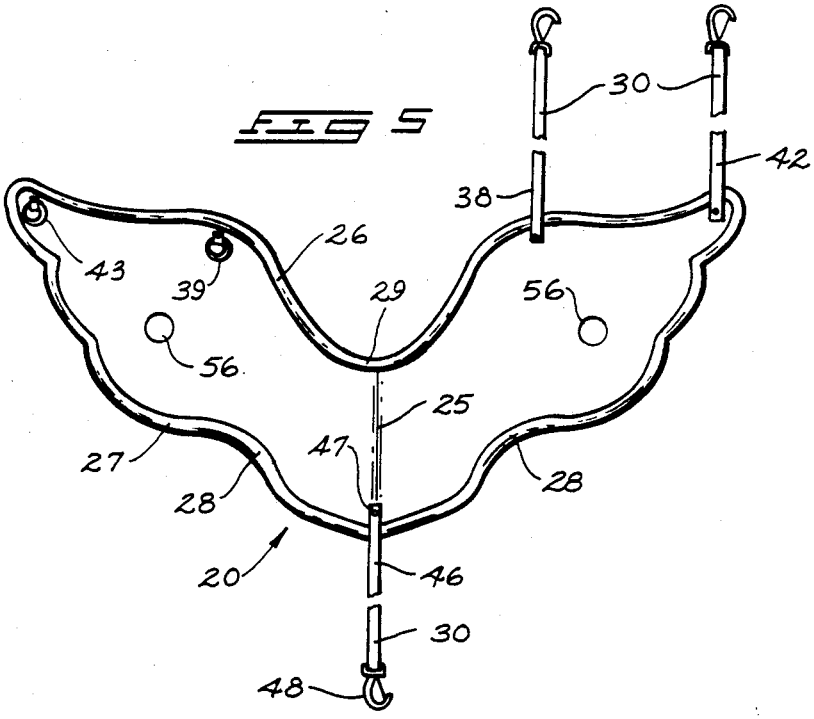
FIG. 5 is a view of the deflector shown in FIG. 3 in a flattened orientation.

The deflector 20 shown in FIGS. 1, 3, and 5 is intended for use primarily with trotter or pacer horses as shown in FIG. 1. The form shown in FIGS. 2 and 4 is intended primarily for use in saddle riding.

Generally, both forms of the deflector 20 are preferably formed from a single sheet of flexible plastic material. The material may be a form of "ABS" plastic currently sold under the trademark "KYDEX" and may include a thickness dimension between 0.040 and 0.125 inches (1 mm to 3.25 mm).

Each deflector form includes a pair of side panels 21 that extend from rearward ends 23 forwardly to a front section 24. The side panels 21 and front section 24 present smooth outwardly-facing surfaces 22 for the purpose of deflecting air and mud. The surfaces are smooth to present little drag during forward motion of the horse and are water-impervious to deflect or shield the chest and shoulder area of the horse. Mud or other debris is deflected from these surfaces that would otherwise be thrown against and accumulate along the chest and shoulder area of the horse during racing.

Each deflector also includes a continuous peripheral edge 26 provided with a padding strip 27. The pad strip 27 may be formed of an appropriate soft material to prevent chafing against the possible areas of contact with adjacent tissues when the deflector is mounted to the horse. Other provisions are also made for comfort and to avoid distraction. For example, shoulder recesses 28 are provided. The recesses 28 are formed along the peripheral edge 26 to be positioned upwardly adjacent the front shoulders of the horse. The recesses will allow free motion of the front legs and shoulders during running, trotting, or pacing. A neck recess 29 is formed centrally between the shoulder recesses and along a top section of the peripheral edge. The neck recess is concave as shown in FIGS. 2 through 5 to receive the horse's neck 11 at the nape or area where the neck 11 joins the breast area 12.

The neck recess may vary with the form of deflector being used. The deflector shown in FIG. 1 includes a recess that can be closely positioned adjacent the neck of the pacer or trotter. This provision is made since these horses carry their heads in a more upright orientation as they trot or pace along. A saddle racing horse, however, runs with the head and neck lowered and stretched forwardly. The neck recess 29 is therefore somewhat deeper in the saddle horse version of the deflector shown in FIGS. 2 and 4.

FIG. 4 shows a horse standing substantially upright. In this position, the pad at the neck recess area may be spaced somewhat forwardly of the horse's chest. It is also positioned slightly below the nape of the neck. However, when the horse is running, the pad will come into close proximity or may actually touch the outstretched neck 11 at the nape area of the breast 12.

Both forms of the present deflector 20 make use of a strap means generally shown at 30 for properly securing the deflector to the horse. The strap means 30 is provided to secure the front section 24 in centered relation to the horse's breast 12 and with the side panels extending rearwardly over the front shoulders 13 and ribs 17 on opposite sides of the horse. The strap means is also used to position the rearward side panel ends 23 adjacent the horse's back 15 just forward of the hips 16. This relationship is best indicated in FIGS. 1 and 4.

The strap means 30 may include a first strap 38 along one of the side panels, positioned thereon to extend over the horse's withers 14 to the opposite side panel. The first strap 38 and opposite side panel are provided with connector means 39 for releasably fastening the free end of the first strap member. The connector means may be comprised of a conventional ring and clip assembly.

The strap means 30 may also include a second strap member 42 with an end secured adjacent the rearward end 23 of one side panel and extendable over the horse's back 15 to the other panel. Similar connector means 43 may be used to releasably secure the free end of the second strap member to the other side panel so the strap will extend between the side panels and over the horse's back 15.

The two strap members 38 and 42 may be adjustable lengthwise by conventional buckles or length adjusting assemblies (not shown) to facilitate elevational positioning of the deflector to suit individual horses. Adjustment of these two straps may also function to change the elevational position of the neck recess 29.

The strap means 30 may also include a breast strap member 46. This strap includes an end 47 secured to the frontal section of the deflector and extends to a free end 48 having a clip or other appropriate fastener thereon for connection to the girth 50 typically used in both harness and saddle racing for securing a saddle member about the back, ribs, and brisket of the horse. The breast strap serves to prevent the deflector from undesired vertical or forward movement on the horse. It also functions to prevent the forward section of the deflector from bouncing.

The front sections 24 of the two deflector forms are distinguishable as indicated in FIGS. 2 and 3. The shape of each section is selected depending upon whether the deflector is to be used for saddle racing or harness racing. With harness racing, the frontal section 24 is integral with the side sections and may be defined simply by a substantially vertical crease or rounded area 25 extending between upper and lower portions of the peripheral edge. The crease 25 is to be centered in relation to the breast area of the horse.

The side panels 21 diverge from this central crease which forms the vertex of an acute angle. The "rays" of the acute angle are comprised of the side panels 21.

The front section of the version shown in FIG. 2 includes a web 34 that spans an area of the front section projecting forwardly of the breast area 12 of the horse. The webbing 34 can be provided as an integral part of the sides and front configuration or attached separately. The web functions also as a reinforcing member to hold the desired "acute" angular relationship between the two side panels. The web includes an indentation defined by a concave web edge 35. The edge 35 is provided with a pad strip section 36 that may be integral with the peripheral pad strip 27. The indentation is helpful to position the central crease 25 in centered relation with the horse's chest. The web configuration with its forwardly projecting front section is intended for use with saddle racing horses since the forwardly projecting section 24 will not interfere with or endanger other horses in the race. The horse's head, when running, projects further ahead than the front section 24. There is also no danger to the riders since they sit astride the horses at an elevation substantially higher than the forward projecting front section. The advantage of this "pointed" configuration is a reduction in frontal surface area and a marked decrease in air "drag" normally produced as the horse runs.

The deflector configuration shown in FIGS. 1, 3 and 5 does not make use of the web 34. Instead, the frontal section 24 is placed more closely adjacent to the horse's breast area 12. This is a safety precaution since forward projection such as the frontal configuration shown in FIG. 2 could possibly become a hazard to drivers riding the cart or sulky at an elevation substantially equal to that of the pointed deflector front. The crease 25 is still provided, however, and the side panels diverge at substantially acute angles. Both forms therefore serve to reduce air drag as the horse moves forwardly and to shield the chest and shoulder areas of the horse against mud and debris.

The harness racing version of the present deflector also includes apertures 56 formed in each of the panels 21. The apertures 56 are of sufficient size to receive the forwardly projecting thimble ends of cart shafts 60. The thimble ends of the shafts can extend through the apertures from inside the panels 21 substantially as shown in FIG. 1. The shafts therefore provide additional support and positioning for the deflector.

The saddle horse version of the present deflector may be attached to a horse during the saddling procedure. The deflector is preferably mounted to the horse after saddling is complete. The deflector may then be initially mounted to the horse by slipping both side panels in a rearward motion to position the rearward ends between the saddle girth and stirrups. The first and second straps and associated connectors may then be fastened and adjusted to determine the proper elevation for the deflector in relation to the shoulder and chest area of the horse. Care is taken to position the first strap member over the withers and the second over the back behind the saddle. Finally, the breast strap can be drawn back between the front legs and attached to the saddle girth. Length adjustments may also be made at this point to secure the deflector in a desired position. Removal of the device from a saddle horse is accomplished simply by reversing the above procedures.

Attachment of the present harness racing version of the deflector to a harness racing horse involves a somewhat similar procedure to that described above. Care is taken, however, to properly insert the shaft thimbles through the apertures 56. Removal is a simple reversal of the mounting procedures.

During use as the horse moves forwardly, the deflector will function to "slice" through the air reducing air drag at the chest area of the horse to a minimum. This is due to the pointed configuration of the front section and the smooth surface and contours of the deflector material. Furthermore, the flexible, yet tough, material of the deflector will shield the chest and shoulder area of the horse against mud and debris that is typically encountered during all forms of horse racing. The debris or mud will be deflected by the smooth surface and not allowed to accumulate, adding weight and drag. Any mud will slide easily from the smooth plastic surfaces 22 and drop to the ground. The horse will therefore be encouraged to put forth a maximum running effort.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A wind and mud deflector for horses, comprising:

an elongated flexible body formed of sheet material including opposed side panels joined at a front section;

said side panels and front section including longitudinal top and bottom edges spaced apart by a distance at the front section such that the front section will cover substantially the entire breast of a horse;

wherein the side panels extend longitudinally from the front section and taper to reduced rearward ends;

strap means on the body for attaching the body to a horse with the frontal section centered on the horse's breast, with the side panels extending rearwardly from the frontal section over the shoulders and ribs on opposite sides of the horse, and with the rearward side panel ends situated adjacent the horse's back and forward of the hips.

2. The wind and mud deflector as claimed by claim 1 wherein the strap means includes a first strap member along one of the side panels and positioned thereon to extend over the horse's withers to the opposite side panel; and connector means on the first strap member and opposite side panel for releasably fastening the first strap member between the side panels.

3. The wind and mud deflector as claimed by claim 2 wherein the strap means includes a second strap member adjacent the rearward end of one of the side panels and positioned thereon to extend over the back of the horse; and connector means on the second strap member and opposite side panel for releasably fastening the second strap member between the side panels and over the back of the horse.

4. The wind and mud deflector for a horse wearing a girth as claimed by claim 1 wherein the strap means further comprises a breast strap member having one end attached to the frontal section and a free remote end adapted for attachment to the girth.

5. The wind and mud deflector as claimed by claim 1 wherein the side panels include a central neck recess and front shoulder receiving recesses formed therein, positionable by the strap means adjacent the horse's neck and front shoulders.

6. The wind and mud deflector as claimed by claim 5 for harness racing horses in which the horse is harnessed to a sulky by shafts projecting forwardly of the sulky, wherein:

the side panels include open apertures for receiving the shafts of the sulky.

7. The wind and mud deflector as claimed by claim 1 for harness racing horses in which the horse is harnessed to a sulky by shafts projecting forwardly of the sulky, wherein:

the side panels include open apertures for receiving the shafts of the sulky.

8. The wind and mud deflector as claimed by claim 1 further comprising a web member extending between the side panels at the front section and including a concave breast receiving indentation.

9. The wind and mud deflector as claimed by claim 8 wherein the front section is formed by the side panels joined along a crease oriented vertically by the strap means in relation to the horse and projecting forward of the horse's breast, and wherein the side panels form an acute angle at the front section with the crease at the vertex thereof.

10. The wind and mud deflector as claimed by claim 1 wherein the front section is formed by the side panels joined along a crease oriented vertically by the strap means in relation to the horse and projecting forward of the horse's breast, and wherein the side panels form an acute angle at the front section with the crease at the vertex thereof.

11. The wind and mud deflector as claimed by claim 10 for harness racing horses in which the horse is harnessed to a sulky by shafts projecting forwardly of the sulky, wherein:

the side panels include open apertures for receiving the shafts of the sulky.

12. The wind and mud deflector as claimed by claim 1 wherein the front section and side panels include peripheral edges, and further comprising:

pad means along the peripheral edges to prevent chafing of said edges against the horse's flesh.

13. The wind and mud deflector as claimed by claim 1 further comprising a web member extending between the side panels at the front section and including a concave breast receiving indentation;

wherein the web includes an edge formed along the concave breast receiving indentation and wherein the pad means is situated along the indentation edge.

14. The wind and mud deflector as claimed by claim 13 wherein the strap means includes a first strap member along one of the side panels and positioned thereon to extend over the horse's withers to the opposite side panel; and connector means on the first strap member and opposite side panel for releasably fastening the first strap member between the side panels.

15. The wind and mud deflector as claimed by claim 14 wherein the strap means includes a second strap member adjacent the rearward end of one of the side panels and positioned thereon to extend over the back of the horse; and connector means on the second strap member and opposite side panel for releasably fastening the second strap member between the side panels and over the back of the horse.

16. The wind and mud deflector for a horse wearing a girth as claimed by claim 15 wherein the strap means further comprises a breast strap member having one end attached to the frontal section and a free remote end adapted for attachment to the girth.

17. The wind and mud deflector as claimed by claim 16 wherein the front section is formed by the side panels joined along a crease oriented vertically by the strap means in relation to the horse and projecting forward of the horse's breast, and wherein the side panels form an acute angle at the front section with the crease at the vertex thereof.

18. The wind and mud deflector as claimed in claim 17 wherein the side panels and front section are integral and formed of a smooth surfaced water-impervious flexible plastic sheet material.

19. The wind and mud deflector as claimed in claim 1 wherein the side panels and front section are integral and formed of a smoother surfaced water-impervious flexible plastic sheet material.

* * * * *